US007247087B1

(12) United States Patent
Poblete et al.

(10) Patent No.: US 7,247,087 B1
(45) Date of Patent: Jul. 24, 2007

(54) FUME HOOD WITH AIR DIRECTING MEMBER

(75) Inventors: Rudolph Poblete, Statesville, NC (US); Robert Haugen, Statesville, NC (US)

(73) Assignee: Kewaunee Scientific Corporation, Statesville, NC (US)

( * ) Notice: Subject to any disclaimer, the term of this patent is extended or adjusted under 35 U.S.C. 154(b) by 142 days.

(21) Appl. No.: 10/893,680

(22) Filed: Jul. 16, 2004

(51) Int. Cl.
*F24C 15/20* (2006.01)

(52) U.S. Cl. ..... 454/56; 454/58; 454/63; 126/299 F

(58) Field of Classification Search ..... 454/56, 454/49, 57, 58, 59, 62, 63
See application file for complete search history.

(56) References Cited

U.S. PATENT DOCUMENTS

| | | | | | |
|---|---|---|---|---|---|
| 3,747,505 | A * | 7/1973 | Turko | 454/59 |
| 4,377,969 | A | 3/1983 | Nelson | 98/115 |
| 4,534,281 | A * | 8/1985 | Parks et al. | 454/59 |
| 4,856,420 | A * | 8/1989 | Poblete et al. | 454/59 |
| 5,241,788 | A | 9/1993 | Buie | 49/95 |
| D346,437 | S | 4/1994 | Poblete et al. | D23/371 |
| 5,407,389 | A | 4/1995 | Poblete et al. | 454/56 |
| 5,447,468 | A * | 9/1995 | Tener et al. | 454/58 |
| 5,556,331 | A * | 9/1996 | Bastian | 454/56 |
| 5,697,838 | A * | 12/1997 | Morris | 454/62 |
| 5,716,267 | A * | 2/1998 | Hambleton et al. | 454/56 |
| 5,718,626 | A | 2/1998 | Rindoks et al. | 454/56 |
| 5,797,790 | A * | 8/1998 | Rindoks et al. | 454/59 |
| 6,302,779 | B1 * | 10/2001 | Ryan et al. | 454/61 |
| 6,350,194 | B1 * | 2/2002 | Haugen et al. | 454/56 |
| 6,428,408 | B1 * | 8/2002 | Bell et al. | 454/56 |
| 6,450,875 | B1 | 9/2002 | Haugen | 454/56 |
| 6,461,233 | B1 * | 10/2002 | Gilkison et al. | 454/57 |
| 6,582,292 | B1 * | 6/2003 | Bastian | 454/59 |
| 6,659,857 | B2 * | 12/2003 | Ryan et al. | 454/56 |
| 6,871,170 | B2 * | 3/2005 | Ryan et al. | 703/9 |

OTHER PUBLICATIONS

Labconco Catalog Entitled: "Protector Laboratory Fume Hoods and Enclosures", 2003.

* cited by examiner

*Primary Examiner*—Derek S. Boles
(74) *Attorney, Agent, or Firm*—Kennedy Covington Lobdell & Hickman, LLP

(57) ABSTRACT

A fume hood adapted to be connected to an exhaust system, the fume hood including a cabinet formed with a chamber having a generally flat bottom wall and a sash door mounted at the front end of the chamber for movement in a vertical plane to provide an access opening to the chamber. An air directing member is mounted on the cabinet outside of the plane of movement of the sash door relative to the chamber and it is generally aligned with the bottom wall. The air directing member is formed with an opening positioned to cause a first path of outside air to flow into the chamber along the surface of the bottom wall and being formed with another portion for directing a second path of outside air in a direction generally parallel to and above the first path.

18 Claims, 4 Drawing Sheets

FUME HOOD WITH AIR DIRECTING MEMBER

BACKGROUND OF THE INVENTION

The present invention relates generally to fume hoods, and more particularly to a fume hood provided with an air directing member uniquely formed to direct the inflow of air into the chamber of the fume hood in a path that prevents fumes from exiting the chamber.

Fume hoods are used in laboratories and other similar locations where it is necessary for technicians to work with materials that generate noxious and poisonous fumes. These fume hoods are formed with an interior, generally enclosed chamber in which the work is done, and the front of the chamber has an access opening through which the arms and hands of the technician can extend to work on materials within the chamber. The fume hood includes a sash or door that moves vertically to open and close the access the opening, or to vary the size of the access opening.

Because of the harmful effects of the fumes generated within the chamber of the fume hood, it is imperative that these fumes be maintained within the confines of the fume hood and then be exhausted therefrom so they will not be permitted to escape though the access opening and endanger the technician standing just outside the access opening. For this purpose, fume hoods are provided with exhaust systems of some kind that exhausts the air and fumes from the interior of the chamber and then transports them to a location outside the fume hood where they can be safely disposed of. The exhaust system creates a negative pressure within the chamber that, in turn, causes outside air to flow into the chamber through the partially open access opening between the bottom of the sash and the work surface of the chamber, and this inward flow of outside air tends to prevent the fumes from exiting the chamber through the access opening. However, if this inward flow of air is not properly directed, some of the fumes will leak out through the access opening and present an undesirable and often dangerous situation for the technician working in the fume hood.

For example, where no structure or device is provided for directing the inward flow of air into the chamber, the momentum of the inward flow of air entering a region of lower static pressure tends to cause a vortex of air to form adjacent along the bottom surface of the chamber and adjacent the front edge thereof. This vortex captures some of the fumes within its generally circular flow pattern, and the vortex is very sensitive to any variation of air pressure or airflow. As a result, even movement of the technician, or someone walking past the partially open access opening can create an external pattern of airflow that is sufficient to disrupt the vortex to an extend that fumes will be released from the chamber through the access opening.

One of the first attempts to correct this problem was to add a permanent air directing plate, or airfoil, that was mounted to the fume hood to extend into the chamber through the bottom of the access opening at a location about one inch above the bottom wall of the chamber. The airfoil is shaped to direct the incoming air along the bottom surface of the chamber, beneath the airfoil, and this airflow essentially eliminates the undesirable fume-carrying vortex. However, this airfoil has its own disadvantages. First, because it is a permanent structure extending through the access opening and into the chamber just above the bottom wall thereof, the airfoil creates a stop member for the sash in its downward movement that prevents the sash from fully closing. Therefore outside air constantly flows into the chamber beneath the airfoil which increases the energy costs in operating the fume hood and its exhaust system. Additionally, because of its location, it creates an obstacle when objects and equipment, particularly heavy objects, had to be moved into and out of the chamber through the access opening.

Another solution to the vortex problem is to mount a simple flat air-directing member at the front edge of the bottom wall of the chamber at an incline thereto and outside of the path of vertical movement of the sash. Because of its location, this airfoil does not interfere with the movement of the sash and does not form a barrier to the movement of objects into and out of the chamber. This type of airfoil has been found, in most cases, to effectively eliminate the formation of the undesirable vortex by directing the incoming air along the surface of the bottom wall of the chamber. However, this type of airfoil is effectively only when the velocity of the airflow into the chamber is at or above approximately seventy feet per minute (70 FPM). Energy conservation considerations now make it very desirable to use a smaller-capacity exhaust system, and reduce the airflow velocity into the chamber to something less that 70 FPM, and at this reduced velocity the air flow directed by the airfoil tends to separate from the bottom surface of the chamber and allow "dead" air containing fumes to form along the bottom surface of the chamber and beneath the separated airflow created by the airfoil. This dead air, like a vortex, is sensitive enough that even small disturbance of the air outside of the access opening (e.g. a technician walking by the front of the fume hood) can cause the dead air with the fumes entrained therein to be drawn outwardly though the access opening.

It has also been proposed to mount an airfoil at the front end of the fume hood for pivotal movement between an operable position and a position where the airfoil has not effect on the airflow. In U.S. Pat. No. 5,556,331 there is disclosed a fume hood with a pivoted airfoil having a single air-directing surface that, in its operable position, directs air along a path parallel to the bottom surface of the fume hood. It appears this construction would have the same problem described above where the velocity of the air is less the 70 FPM. U.S. Pat. No. 6,582,292 discloses another pivoted airfoil having multiple air-directing surfaces. In both of these patents, the air directing member is positioned inwardly of the plane of the sash or door, and this location creates problems in terms of maintaining the inward flow of air along the bottom surface of the interior of the fume hood, particularly at low air velocities.

SUMMARY OF THE INVENTION

Briefly described, the present invention provides an air foil for use with a fume hood adapted to be connected to an exhaust system. The fume hood includes a cabinet formed with a chamber having a generally flat bottom wall and a sash door mounted at the front end of the chamber for movement in a vertical plane to provide an access opening to the chamber. An air directing member is mounted on the cabinet outside of the plane of movement of the sash door relative to the chamber and generally aligned with the bottom wall. The air directing member is formed with an opening positioned to cause a first path of outside air to flow into the chamber along the surface of the bottom wall and is formed with a second portion for directing a second path of outside air in a direction generally parallel to and above the first path.

In the preferred embodiment of the present invention, the air directing member is formed with a first generally flat guide surface extending upwardly from the opening toward the front edge of the bottom wall, and the second portion of the air directing member includes a second generally flat guide surface extending in a direction generally parallel to the first guide surface, with the second guide surface being spaced outward from the first guide surface relative to the plane of movement of the sash door.

Additionally, if desired, the air directing member may be formed with a connecting wall portion extending between the first and second guide surfaces, and the opening, which is preferably a series of aligned slots, may be formed in the connecting wall portion. The connecting wall may extend in a generally vertical direction between the first and second guide surfaces.

The present invention also includes a method of directing air into the interior chamber of a fume hood that has a bottom wall and a sash door movable in a vertical plane to provide an access opening to the chamber. This method includes the steps of creating a vacuum within the chamber to draw outside air into the chamber through the access opening provided by the sash door, mounting an air directing member on the fume hood outside of the vertical plane of movement of the sash door, and utilizing the air directing member to create a first path of movement of the outside air to flow into the chamber along the surface of the bottom wall and to create a second path of movement of the outside air in a direction generally parallel to and above the first path of air movement so that the second path of movement of the outside air assists in maintaining the first path of movement of the outside air adjacent to the bottom wall of the chamber.

Preferably, the step of creating the second path of movement of the outside air includes passing the outside air along a second generally flat guide surface extending in a direction generally parallel to the first guide surface and spaced outwardly from the first guide surface relative to the plane of movement of the sash door.

It is also preferred that the step of creating the second path of movement of the outside air includes passing the outside air along a second generally flat guide surface, extending in a direction generally parallel to the first guide surface and spaced outwardly from the first guide surface relative to the plane of movement of the sash door.

DESCRIPTION OF THE PREFERRED EMBODIMENT

Figure 1:
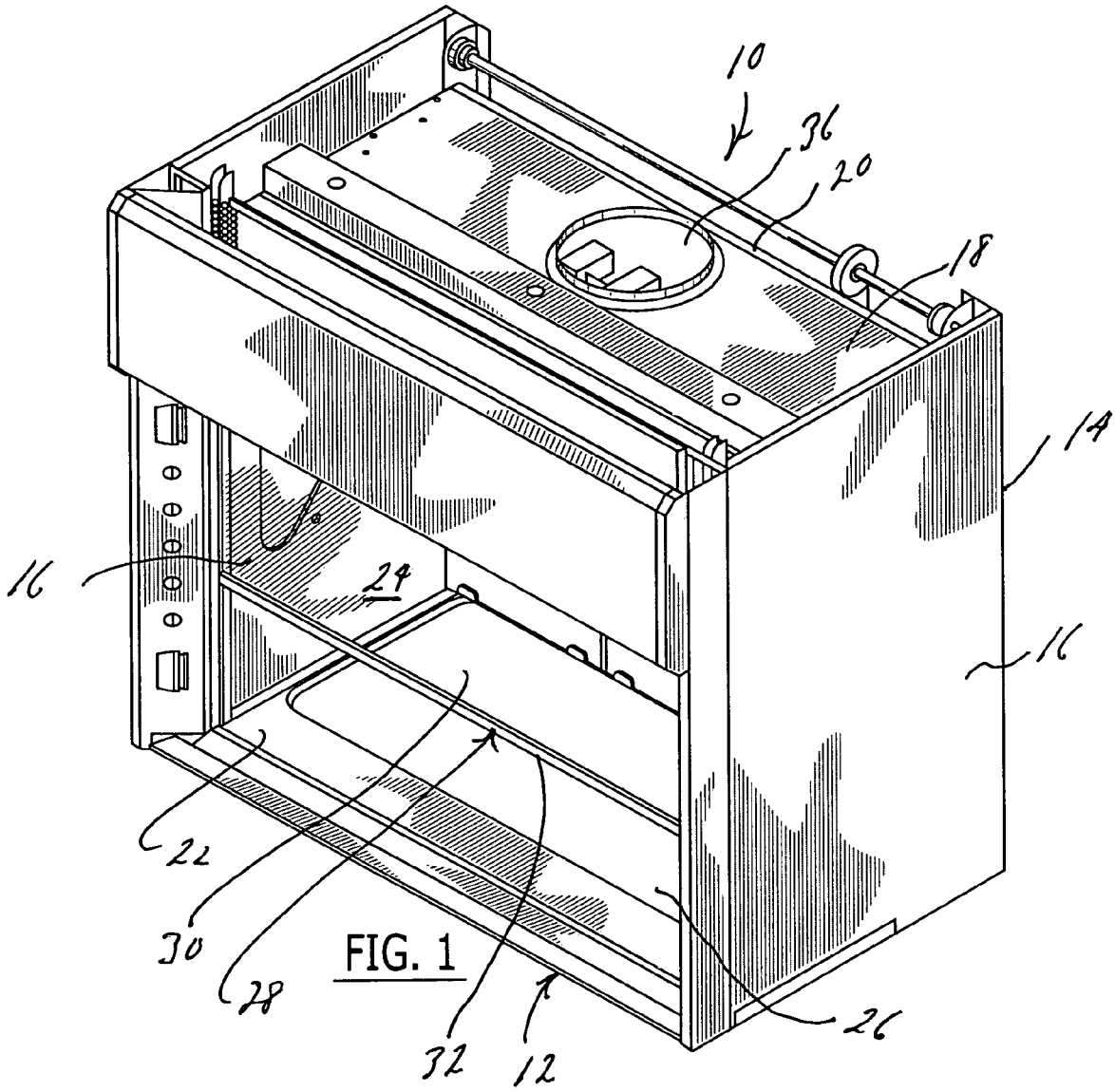
FIG. 1 is a perspective view of a fume hood embodying the present invention.

Looking now in greater detail at the accompanying drawings, FIG. 1 illustrates a typical and conventional fume hood 10 on which is mounted an air foil or air directing member 12 in accordance with the present invention.

Figure 2:
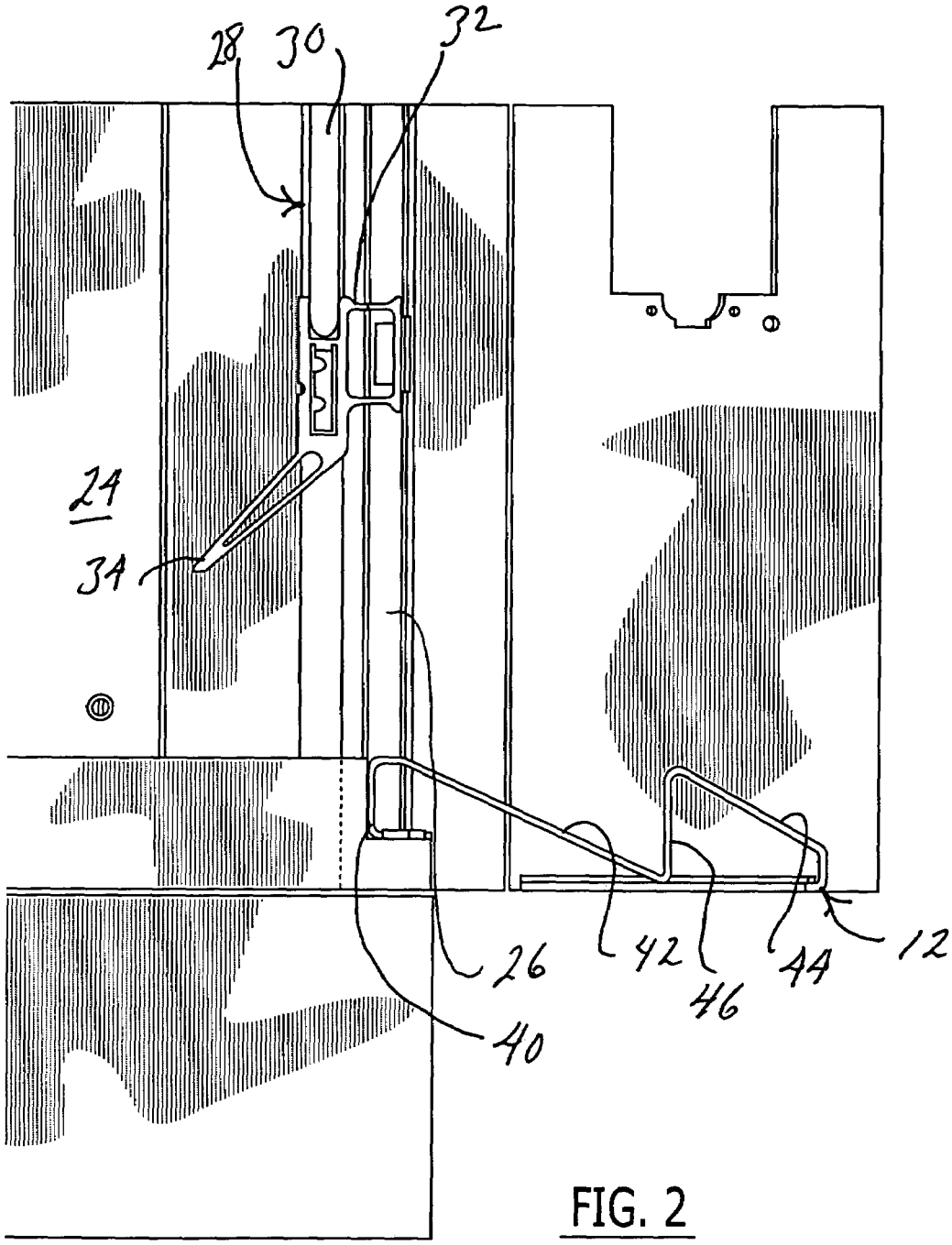
FIG. 2 is a detail side elevation view of the fume hood illustrated in FIG. 1.

The fume hood 10 includes a cabinet 14 consisting of two side walls 16, a top wall 18, a back wall 20, and a generally flat bottom wall 22. These walls 16, 18, 20 and 22 form a generally enclosed interior chamber 24 that has an access opening 26 at the front of the chamber 24. A sash or door 28 is mounted in the cabinet 14 for up and down movement in a vertical plane to open and close the access opening 26. As best seen in FIG. 2, the sash 28 consists primarily of a clear panel 30 formed of glass or any other desired material so that users of the fume hood 10 can see into the chamber 24 through the clear panel 30. The sash 28 may also include a handle 32 for moving the sash 28 up and down in its vertical plane of movement, and it may also include an air deflector 36 located at the bottom edge of the sash 28 for deflecting air passing into the chamber 24 under the sash 28 when it is in a raised position to create the access opening 26.

The cabinet 14 is also formed with an exhaust opening 36 through which air from within the cabinet 14 is exhausted. As is well known in the art, an exhaust system usually consist of a system of conduits and blowers within the building (e.g. a laboratory) in which the fume hood is located, and this system is used to exhaust air from all of the fume hoods and any other equipment that may be generating noxious or harmful gases. However, if desired or required, other equivalent exhaust systems could be used, such as, for example, individual blowers for the fume hoods. In whatever from it takes, the exhaust system is arranged to draw air outwardly from the interior chamber 24 where noxious gases may be produced, and this air is exhausted through the exhaust opening 36 and transported away from the fume hood 10 through conduits (not shown) that transport the air and noxious gases to a safe location away from the user of the fume hood and the environment in which the user is working.

Figure 3:
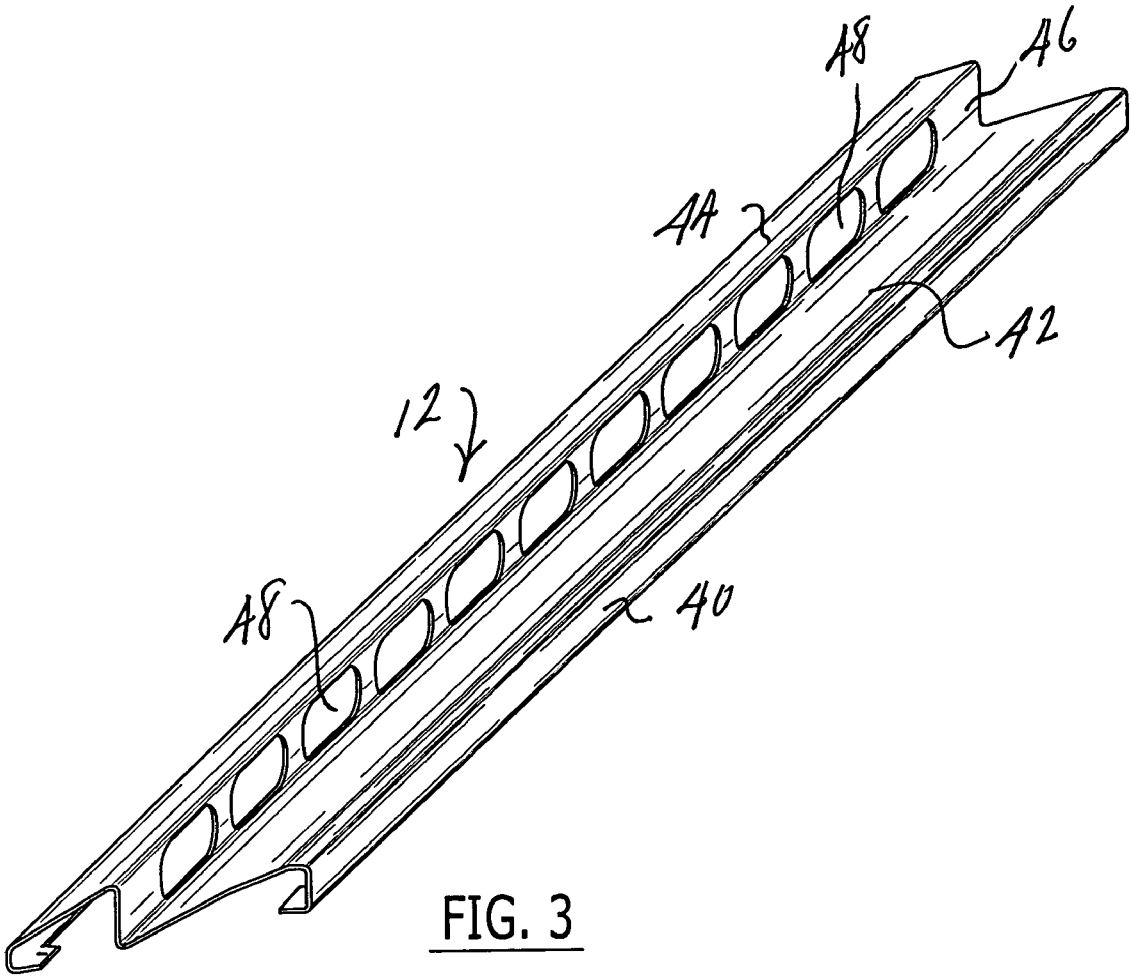
FIG. 3 is a detail view of the air foil member of the present invention.
Figure 4:
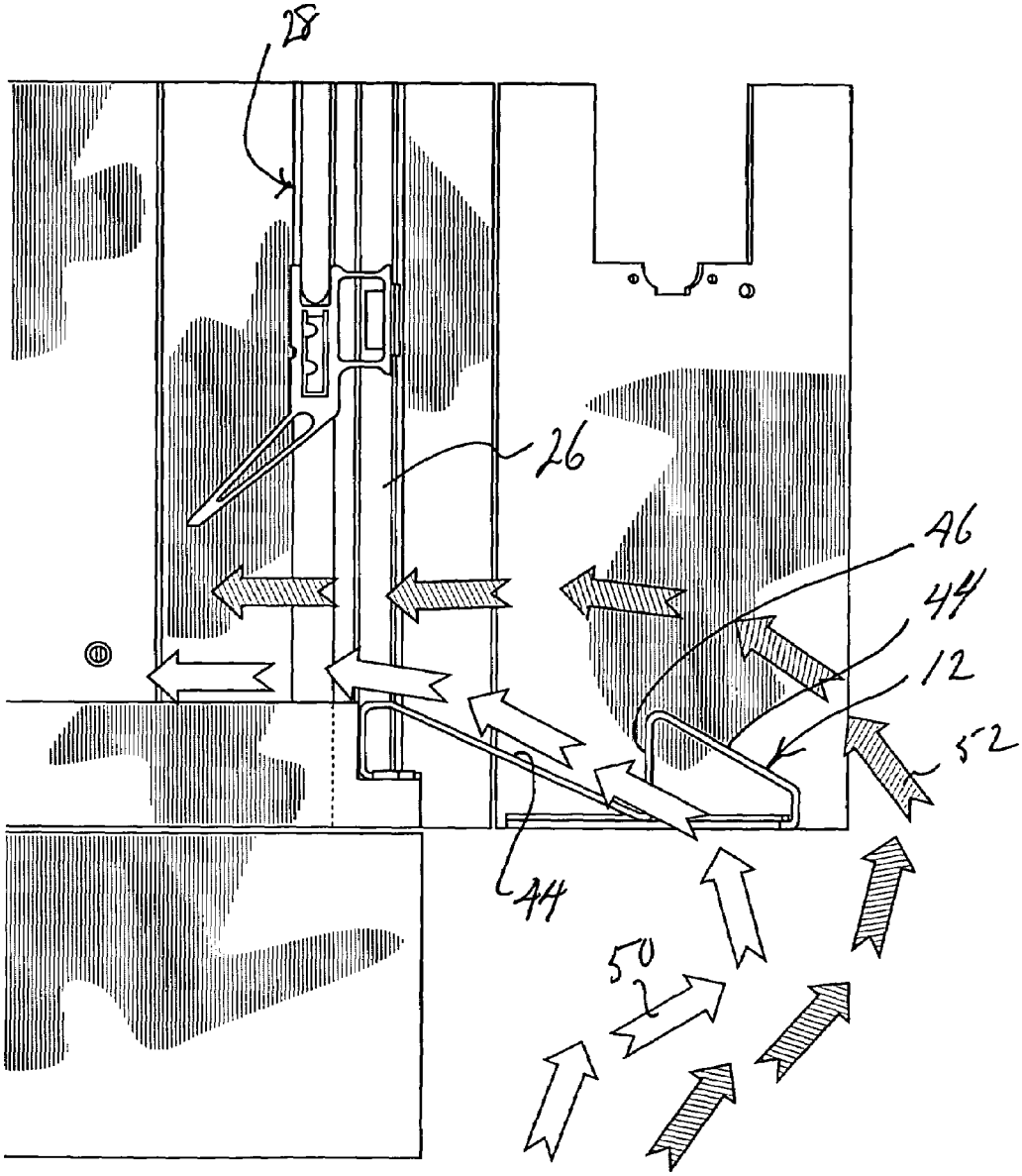
FIG. 4 is a diagrammatic view illustrating the flow of air into the fume hood.

As best seen in FIGS. 2-4, the air foil or air directing member 12 is mounted at the front face of the fume hood 10 just outside of the vertical plane of movement of the sash 28 relative to the chamber 24, and the air foil 12 extends outwardly from the front face of the fume hood 10 in a direction generally aligned with the bottom wall 22 of the cabinet 14.

The air foil 12 includes an attachment in portion 40 by which it is attached to the fume hood 10 as described above. The air foil 12 also includes a first generally flat guide surface 42 extending upwardly toward the front edge of the cabinet bottom wall 22 and a second generally flat guide surface 44 extending parallel to the first guide surface 42 and spaced outwardly therefrom. A connecting wall 46 extends generally vertically from the front end of the second wall portion 44 to the rear end of the first wall portion 42 as best seen in FIG. 3, and the connecting wall portion 46 is formed with at least one opening 48 extending therethrough. Preferably, the connecting wall 46 is formed with a plurality of aligned openings 48 as best illustrated in FIG. 3. Finally, the outward or bottom end of the second guide surface 44 extends generally vertically downwardly, and is turned inwardly as best seen in FIG. 2-4.

When the sash 28 is raised to create the access opening 26, and when the exhaust system is energized to withdraw air through the exhaust opening 36, the location and construction of the air foil 12 creates a unique air flow pattern that is diagrammatically illustrated in FIG. 4.

More specifically, air withdrawn through the exhaust opening 36 creates a negative pressure within the cabinet 14, and outside air, identified as "lab air" in FIG. 4, is drawn inwardly into the cabinet 14 through the access opening 26. This inward flow of air is directed along two separate and distinct but complimentary paths of movement. First, as indicated by the open arrows 50 in FIG. 4, a first path of movement of the outside air is created which passes through the openings 48 in the connecting wall 46, then upwardly along the first guide surface 42 and into the cabinet 14 generally along the bottom wall 22 of the cabinet 14. At the same time, the air flows along a second path of movement indicated by the solid arrows 52 in FIG. 5. The outward end portion of the air flow 12 and the second guide surface 44 create a barrier that causes the second path of movement of the air to flow upwardly above the air foil 12 and inwardly through the access opening 26 in a direction generally parallel to the first path of movement so that the second path of movement of the outside air intends to maintain the first path of movement of the outside air flowing along and closely adjacent the bottom wall 22.

Accordingly, the unique air flow pattern created by the present invention overcomes the drawbacks of known prior art arrangements described above. First, it will be noted that the air foil 12 is positioned, in its entirety, at or below the plane of the cabinet bottom wall 22, and therefore it does not create any obstacle to the movement of equipment or materials into and out of the interior cabinet 14 along the bottom wall 22. Moreover, even at low air velocities (e.g. less than 70 fpm) the first path of air movement indicated by the open arrows 50 sweeps along the bottom wall 22 to remove noxious gases away from the access opening 26, and the second path of movement indicated by the solid arrows 52 tends to contain or "police" the air flowing along the first path of movement to prevent the formation of undesirable vortexes in the air flowing along the first path of movement. Even if the air flowing inwardly through the access opening is temporarily disrupted, such as by a user walking past the front face of the fume hood 10, the tendency of this movement to create a vortex in the first path of movement is significantly resisted by the policing action of the air flowing along the second path of movement and the tendency of the second path of air movement to resist any tendency of the first path of air movement to separate upwardly from the surface of the bottom wall 22.

In view of the aforesaid written description of the present invention, it will be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor is to be construed to limit the present invention or otherwise to exclude any such other embodiments, adaptations, variations, modifications and equivalent arrangements, the present invention being limited only by the claims appended hereto and the equivalents thereof.

What is claimed is:

1. A fume hood adapted to be connected to an exhaust system, said fume hood including:

(a) a cabinet formed with a chamber having a generally flat bottom wall and a sash door mounted at the front end of said chamber for movement in a vertical plane to provide an access opening to said chamber; and (b) an air directing member mounted on said cabinet so that said air directing member is positioned entirely outside of said plane of movement of said sash door relative to said chamber and generally aligned with said bottom wall, said air directing member being formed with an opening positioned to cause a first path of outside air to flow into said chamber along the surface of said bottom wall and being formed with a second portion for directing a second path of outside air in a direction generally parallel to and above said first path.

2. A fume hood as defined in claim 1, wherein said air directing member is formed with a first generally flat guide surface extending upwardly from said opening toward the front edge of said bottom wall.

3. A fume hood as defined in claim 2, wherein said second portion of said air directing member includes a second generally flat guide surface extending in a direction generally parallel to said first guide surface, said second guide surface being spaced outward from said first guide surface relative to said plane of movement of said sash door.

4. A fume hood as defined in claim 3, wherein said air directing member is formed with a connecting wall portion extending between said first and second guide surfaces, and wherein said opening is formed in said connecting wall portion.

5. A fume hood as defined in claim 4, wherein said connecting wall extends in a generally vertical direction between said first and second guide surfaces.

6. A fume hood as defined in claim 1, wherein said opening in said air directing member consists of a series of aligned slots.

7. An air directing member for use with a fume hood that includes a cabinet formed with a chamber having a generally flat bottom wall and a sash door mounted at the front end of said chamber for movement in a vertical plane to provide an access opening to said chamber and an exhaust system for exhausting air from said chamber, said air directing member being adapted to be mounted on said cabinet so that said air directing member is positioned entirely outside of said plane of movement of said sash door relative to said chamber and generally aligned with said bottom wall, and said air directing means being formed with an opening therein positioned to cause a first path of outside air to flow into said chamber along the surface of said bottom wall and being formed with a second portion for directing a second path of outside air in a direction generally parallel to and above said first path.

8. An air directing member as defined in claim 7, wherein said air directing member is formed with a first generally flat guide surface extending upwardly from said opening toward the front edge of said bottom wall.

9. An air directing member as defined in claim 8, wherein said second portion of said air directing member includes a second generally flat guide surface extending in a direction generally parallel to said first guide surface, said second guide surface being spaced outward from said first guide surface relative to said plane of movement of said sash door.

10. An air directing member as defined in claim 9, wherein said air directing member is formed with a connecting wall portion extending between said first and second guide surfaces, and wherein said opening is formed in said connecting wall portion.

11. An air directing member as defined in claim 10, wherein said connecting wall extends in a generally vertical direction between said first and second guide surfaces.

12. An air directing member as defined in claim 7, wherein said opening in said air directing member consists of a series of aligned slots.

13. A fume hood adapted to be connected to an exhaust system, said fume hood including:

(a) a cabinet formed with a chamber having a generally flat bottom wall and a sash door mounted at the front end of said chamber for movement in a vertical plane to provide an access opening to said chamber; and (b) an air directing member mounted on said cabinet so that said air directing member is positioned entirely outside of said plane of movement of said sash door relative to said chamber and generally aligned with said bottom wall, said air directing member being formed with a first generally flat guide surface extending upwardly from said opening toward the front edge of said bottom wall, a second generally flat guide surface extending parallel to said first guide surface and spaced outwardly therefrom relative to said plane of movement of said sash door, and a connecting wall extending generally vertically from the front end of said second wall portion to the rear end of said first wall portion, said connecting wall portion being formed with an opening therein to cause said outside air to flow along a first path of outside air through said opening and along said first wall portion and into said chamber, and to cause said outside air to flow along a second path of movement along the surface of said second wall portion and in a direction generally parallel to and above said first path, whereby said second path of movement of said outside air tends to maintain said first path of movement of said outside air flowing along the surface of said bottom wall of said chamber.

14. A method of directing air into the interior chamber of a fume hood that has a bottom wall and a sash door movable in a vertical plane to provide an access opening to said chamber, said method comprising the steps of:

(a) creating a negative pressure within said chamber to draw outside air into said chamber through the access opening provided by said sash door;

(b) mounting an air directing member on said fume hood so that said air directing member is positioned entirely outside of said vertical plane of movement of said sash door; and (c) utilizing said air directing member to create a first path of movement of said outside air to flow into said chamber along the surface of said bottom wall and to create a second path of movement of said outside air in a direction generally parallel to and above said first path of air movement so that said second path of movement of said outside air assists in maintaining said first path of movement of said outside air adjacent to said bottom wall of said chamber.

15. A method of directing air into the interior chamber of a fume hood as defined in claim 13, wherein said step of creating said first path of movement of said outside air includes passing said outside air through openings in said air directing member and upwardly along a flat surface of said air directing member toward said bottom wall of said chamber.

16. A method of directing air into the interior chamber of a fume hood as defined in claim 14, wherein said step of creating said second path of movement of said outside air includes passing said outside air along a second generally flat guide surface extending in a direction generally parallel to said first guide surface and spaced outwardly from said first guide surface relative to said plane of movement of said sash door.

17. A fume hood adapted to be connected to an exhaust system, said fume hood including:

a cabinet formed with a chamber having a generally flat bottom wall and a sash door mounted at the front end of said chamber for movement in a vertical plane to provide an access opening to said chamber; and an air directing member mounted on said cabinet outside of said plane of movement of said sash door relative to said chamber and generally aligned with said bottom wall, said air directing member being formed with an opening positioned to cause a first path of outside air to flow into said chamber along the surface of said bottom wall and being formed with a second portion for directing a second path of outside air in a direction generally parallel to and above said first path;

wherein said air directing member is formed with a first generally flat guide surface extending upwardly from said opening toward the front edge of said bottom wall;

wherein said second portion of said air directing member includes a second generally flat guide surface extending in a direction generally parallel to said first guide surface, said second guide surface being spaced outward from said first guide surface relative to said plane of movement of said sash door; and wherein said air directing member is formed with a connecting wall portion extending in a generally vertical direction between said first and second guide surfaces, and wherein said opening is formed in said connecting wall portion and consists of a series of slots.

18. An air directing member for use with a fume hood that includes a cabinet formed with a chamber having a generally flat bottom wall and a sash door mounted at the front end of said chamber for movement in a vertical plane to provide an access opening to said chamber and an exhaust system for exhausting air from said chamber, said air directing member being adapted to be mounted on said cabinet outside of said plane of movement of said sash door relative to said chamber and generally aligned with said bottom wall, and said air directing means being formed with an opening therein positioned to cause a first path of outside air to flow into said chamber along the surface of said bottom wall and being formed with a second portion for directing a second path of outside air in a direction generally parallel to and above said first path, wherein said air directing member is formed with a first generally flat guide surface extending upwardly from said opening toward the front edge of said bottom wall, wherein said second portion of said air directing member includes a second generally flat guide surface extending in a direction generally parallel to said first guide surface, said second guide surface being spaced outward from said first guide surface relative to said plane of movement of said sash door, wherein said air directing member is formed with a connecting wall portion extending in a generally vertical direction between said first and second guide surfaces, and wherein said opening is formed in said connecting wall portion and consists of a series of slots.

* * * * *